US005440070A

United States Patent [19]

Okamoto et al.

[11] Patent Number: 5,440,070

[45] Date of Patent: Aug. 8, 1995

[54] ELECTRONIC MUSICAL INSTRUMENT HAVING SELECTABLE ANGLE-TO-TONE CONVERSION

[75] Inventors: Tetsuo Okamoto; Naota Katada, both of Hamamatsu, Japan

[73] Assignee: Yamaha Corporation, Japan

[21] Appl. No.: 114,379

[22] Filed: Aug. 30, 1993

[30] Foreign Application Priority Data

Sep. 2, 1992 [JP] Japan ..... 4-234562

[51] Int. Cl.[6] ..... G10H 1/32

[52] U.S. Cl. ..... 84/600; 84/615; 84/644; 84/653

[58] Field of Search ..... 84/600, 644, 737, 743, 84/615, 653

[56] References Cited

U.S. PATENT DOCUMENTS 5,022,303 6/1991 Suzuki et al. ..... 84/600
5,119,709 6/1992 Suzuki et al. ..... 84/600
5,127,301 7/1992 Suzuki et al. ..... 84/600
5,147,969 9/1992 Hiyoshi et al. ..... 84/600
5,166,462 11/1992 Suzuki et al. ..... 84/600
5,241,126 8/1993 Usa et al. ..... 84/615
5,290,964 3/1994 Hiyoshi et al. ..... 84/600

FOREIGN PATENT DOCUMENTS

0264782A2 10/1987 European Pat. Off. .

*Primary Examiner*—William M. Shoop, Jr.
*Assistant Examiner*—Jeffrey W. Donels
*Attorney, Agent, or Firm*—Graham & James

[57] ABSTRACT

An electronic musical instrument has a plurality of detectors, a plurality of converters and a selector. The plurality of detectors, which are arranged, respectively, at predetermined joints of a human body or in the vicinity thereof, detect angles formed by respective ones of the predetermined joints, and generate a plurality of angle data indicative of the respective detected angles. The plurality of converters have different input/output characteristics and thereby convert the plurality of angle data into respective single frequency data each indicative of a frequency of a musical tone. The selector selects desired one from among the plurality of converters.

7 Claims, 11 Drawing Sheets

NOTE

| LEFT / RIGHT | 1 | 2 | 3 |
|---|---|---|---|
| 1 | C | E | G |
| 2 | D | F | A |
| 3 | E | G | B |

*FIG.5A-A*
n=1
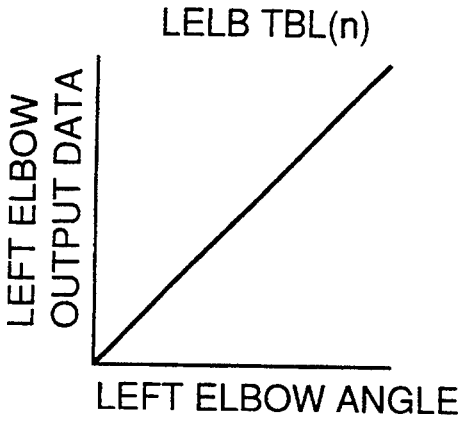
*FIG.5A-B*
n=1
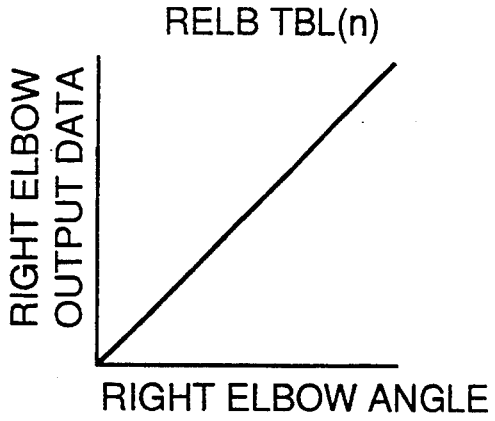
*FIG.5A-C*
n=1
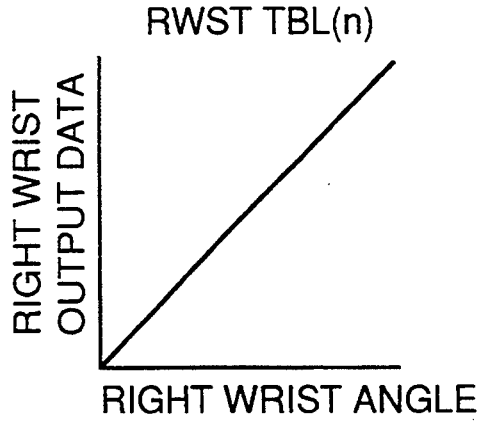

*FIG.5B-A*
n=2
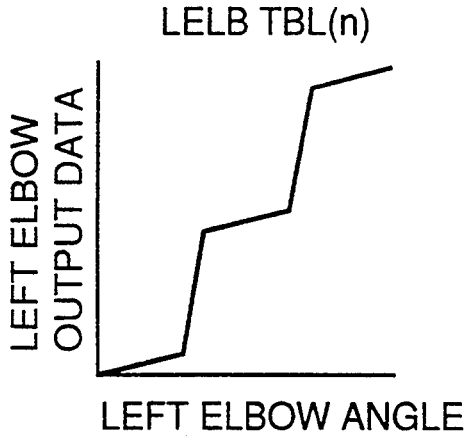
*FIG.5B-B*
n=2
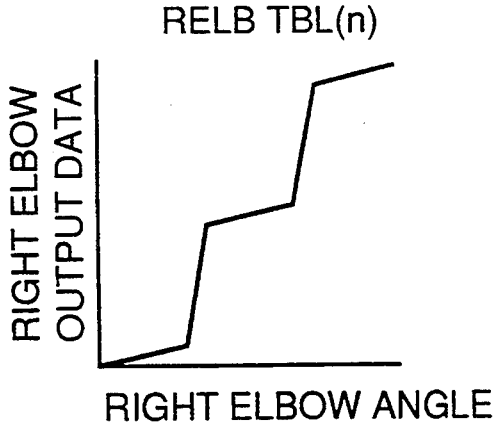
*FIG.5B-C*
n=2
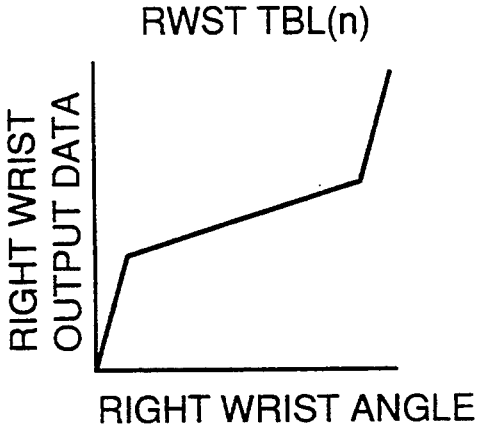

*FIG.5C-A*
n=3
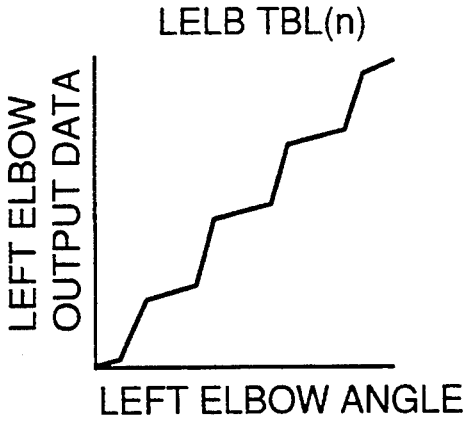
*FIG.5C-B*
n=3
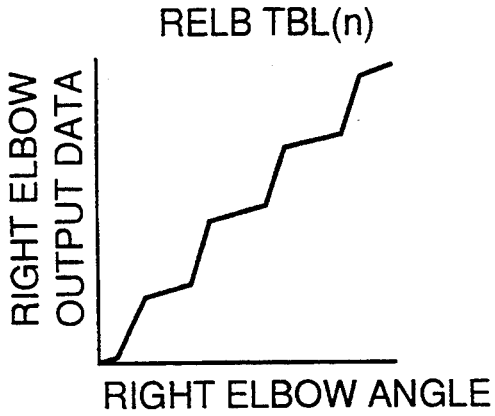
*FIG.5C-C*
n=3
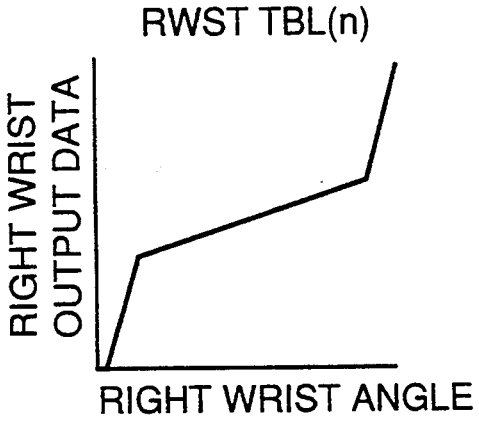

FIG.5D-A
n=4
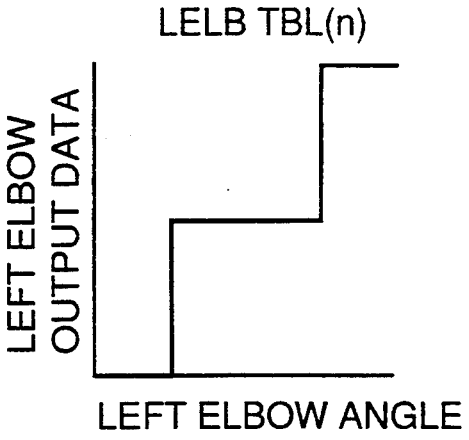
FIG.5D-B
n=4
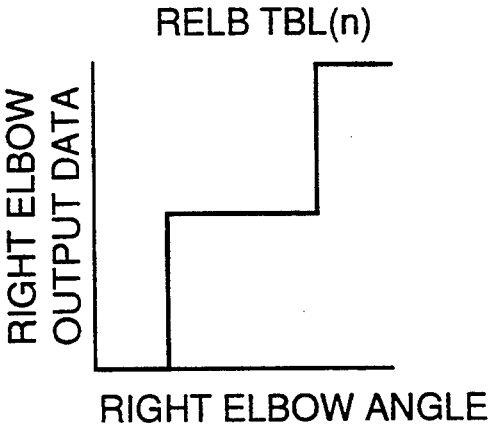
FIG.5D-C
n=4
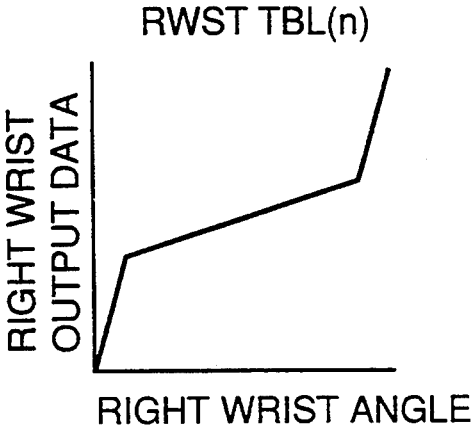

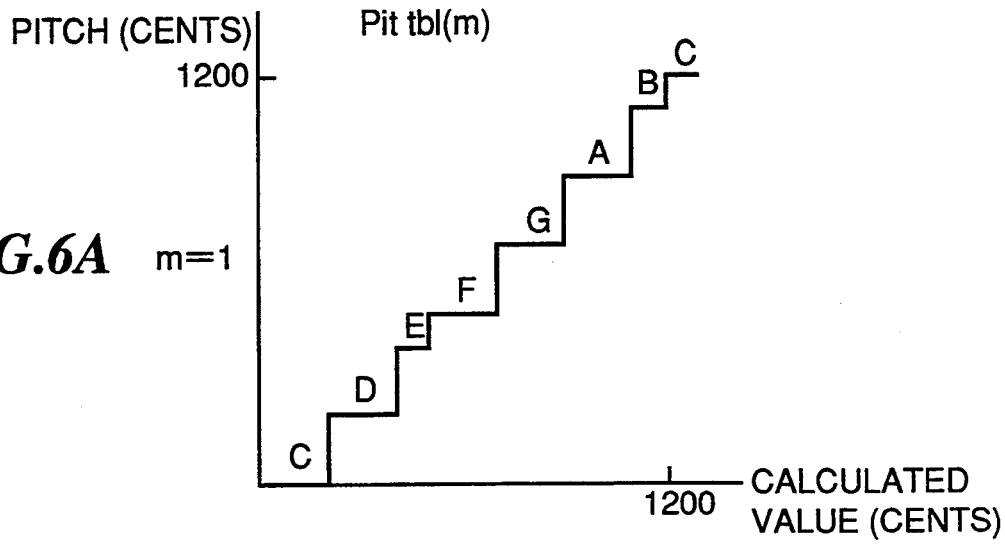
*FIG.6A* m=1
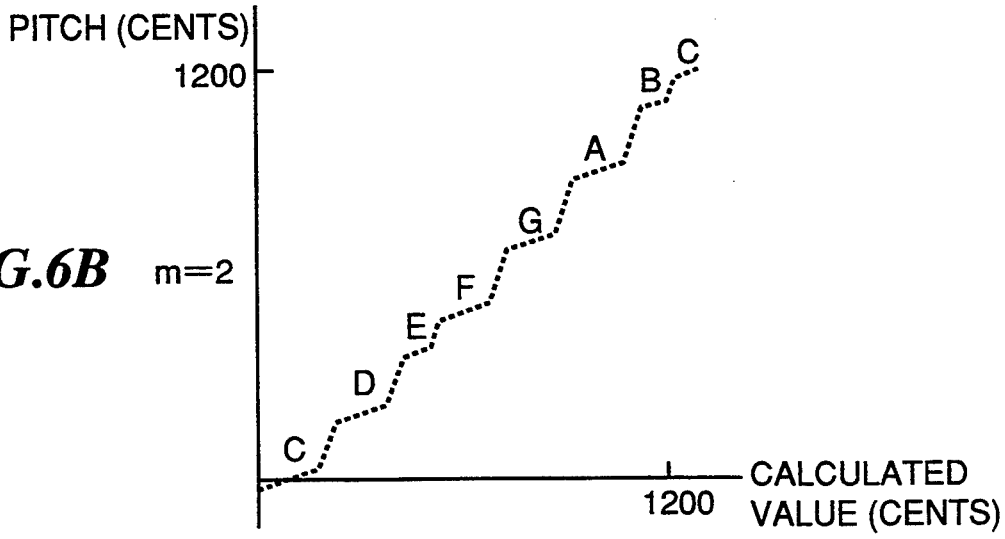
*FIG.6B* m=2
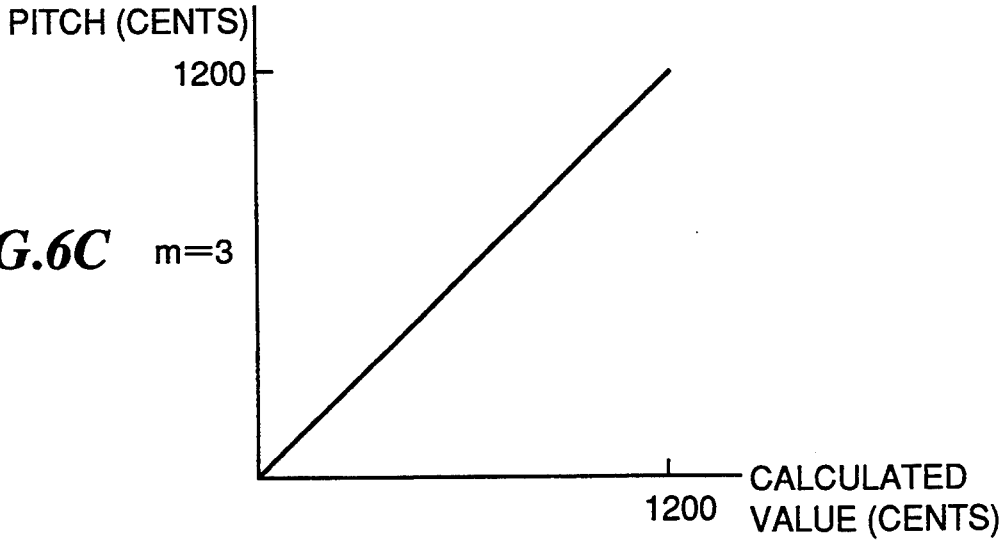
*FIG.6C* m=3

ELECTRONIC MUSICAL INSTRUMENT HAVING SELECTABLE ANGLE-TO-TONE CONVERSION

BACKGROUND OF THE INVENTION

1. Field of the Invention

This invention relates to an electronic musical instrument which is adapted to control musical tones according to the angles of an elbow, a wrist etc. of the operator (i.e. by gesture).

2. Prior Art

A so-called gesturing electronic musical instrument has been proposed, which is adapted to control musical tones by motions of the operator's arms and hands. For example, a conventional gesturing electronic musical instrument is known, which determines the pitch of a musical tone to be generated, according to the angles of the operator's elbows. According to this electronic musical instrument, the angle to be formed by each of the arms is divided into three ranges, as shown in FIG. 1A, and the pitch or frequency of a musical tone to be generated is determined by the use of a matrix of 3 (ranges)×3 (ranges) obtained by the division of the angles of the elbows, as shown in FIG. 1B. Another gesturing electronic musical instrument has been proposed, which determines the pitch or frequency of a musical tone to be generated, directly according to the angles of the elbows so as to continuously vary the pitch of musical tones with changes in the elbow angles, instead of dividing the angle formed by the bent arm into ranges as in the aforesaid electronic musical instrument.

However, these conventional electronic musical instruments each employ a single fixed pitch-determining pattern per each instrument in determining the pitch of musical tones to be generated. Therefore, the operator or player is unable to change the manner of determining the pitch according to his own style of playing.

SUMMARY OF THE INVENTION

It is the object of the invention to provide an electronic musical instrument which enables the operator or player to select the manner of determining the pitch of musical tones to be generated as desired according to his own style of playing.

To attain the object, according to a first aspect of the present invention, there is provided an electronic musical instrument comprising:

a plurality of detecting means arranged, respectively, at predetermined joints of a human body or in the vicinity thereof, for detecting angles formed by respective ones of the predetermined joints, and for generating a plurality of angle data indicative of the respective detected angles;

a plurality of converting means having different input/output characteristics, for converting the plurality of angle data into respective single frequency data each indicative of a frequency of a musical tone; and selecting means for selecting a desired converting means out of the plurality of converting means.

Preferably, the converting means comprise at least one first converting means each having a first linear input/output characteristic which has a first frequency characteristic curve (line) linearly varying relative to the angles, and at least one second converting means each having a second input/output characteristic which has a second frequency characteristic curve varying at different rates relative to the angles between at least one predetermined range of the angles and other ranges of the angles adjacent to the at least one predetermined range.

More preferably, the at least one first converting means includes at least two converting means of which the first frequency characteristic curves vary at substantially constant rates but different from each other, relative to the angles.

Also preferably, the at least one second converting means has the second frequency characteristic curve having a plurality of regions corresponding, respectively, to a plurality of ranges of the angles, the regions of the second frequency characteristic curve comprising at least one region varying at a higher rate relative to the angles, and at least one region varying at a lower rate relative to the angles.

According to a second aspect of the invention, there is provided an electronic musical instrument comprising:

a plurality of detecting means arranged, respectively, at predetermined joints of a human body or in the vicinity thereof, for detecting angles formed by respective ones of the predetermined joints, and for generating a plurality of angle data indicative of the respective detected angles;

a plurality of first converting means having different input/output characteristics, for converting the plurality of angle data into respective single frequency data each indicative of a frequency of a musical tone;

a plurality of second converting means having different input/output characteristics, for converting the frequency data obtained by the first converting means into respective single output data indicative of the musical tone to be generated by the electronic musical instrument; and selecting means for selecting desired first and second converting means out of the plurality of first and second converting means.

More preferably, the second converting means comprise at least one converting means each having a linear input/output characteristic which has a frequency characteristic curve (line) linearly varying relative to the frequency of the musical tone, and at least one converting means each having an input/output characteristic which has a frequency characteristic curve varying at different rates relative to the frequency of the musical tone between at least one predetermined range of the angles and other ranges of the angles adjacent to the at least one predetermined range.

According to a third aspect of the invention, there is provided an electronic musical instrument comprising:

a plurality of detecting means arranged, respectively, at predetermined joints of a human body or in the vicinity thereof, for detecting angles formed by respective ones the predetermined joints, and for generating a plurality of angle data indicative of the respective detected angles;

a plurality of converting means having different input/output characteristics, for converting the plurality of angle data into respective single frequency data each indicative of a frequency of a musical tone; and selecting means for selecting a desired converting means out of the plurality of converting means according to a style of playing by an operator operating the electronic musical instrument.

The above and other objects, features, and advantages of the invention will become more apparent from the following detailed description taken in conjunction with the accompanying drawings.

BRIEF DESCRIPTION OF THE DRAWINGS

FIG. 5A is a diagram showing input/output characteristics of controllers appearing in FIG. 2;

FIG. 5B is a diagram showing other examples of input/output characteristics of the controllers;

FIG. 5C is a diagram showing still other examples of input/output characteristics of the controllers;

FIG. 5D is a diagram showing further examples of input/output characteristics of the controllers;

FIG. 6A is a diagram showing a pitch-conversion table for determining the pitch of musical tones from synthesized data obtained from outputs from the controllers appearing in FIG. 5A to FIG. 5D;

FIG. 6B is a diagram showing another example of the pitch-conversion table, similar to FIG. 6A;

FIG. 6C is a diagram showing still another example of the pitch-conversion table, similar to FIG. 6A;

in FIG. 9.

DETAILED DESCRIPTION

The invention will now be described in detail with reference to drawings showing an embodiment thereof.

Figures 1A, 1B:
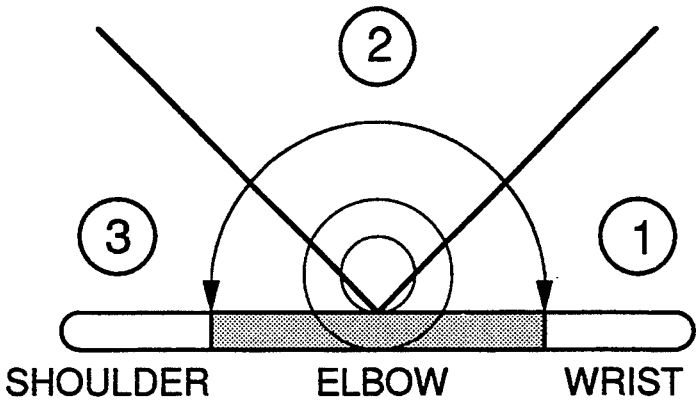
FIG.1A PRIOR ART
FIG.1B PRIOR ART
FIG. 1A is a schematic view useful in explaining a manner of determining the pitch of musical tones to be generated, according to a conventional gesturing electronic musical instrument, and in which are shown three divided angle ranges of an arm.
FIG. 1B shows a matrix of 3×3 formed by the three divided ranges of the arms.
Figure 2:
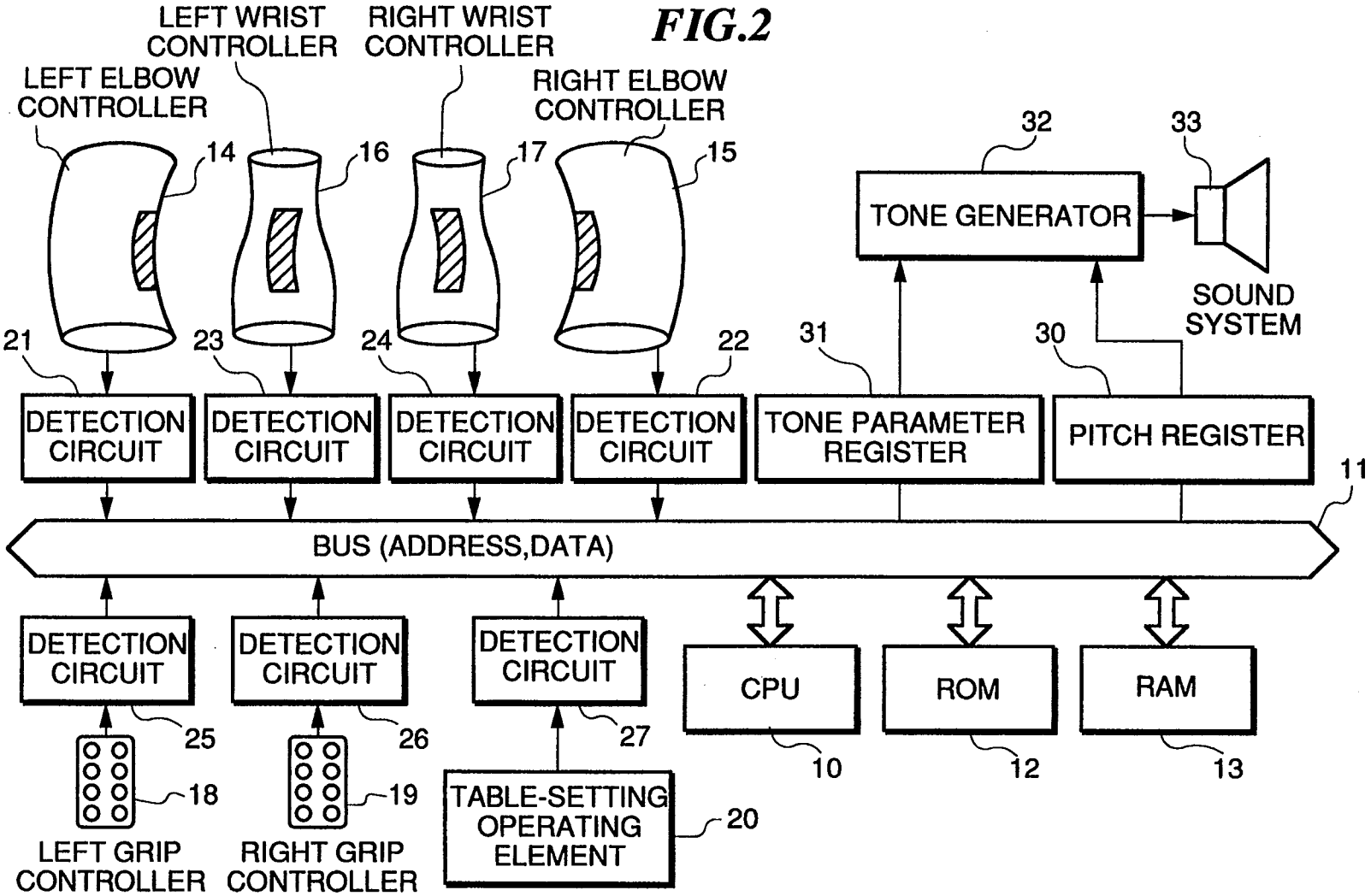
FIG. 2 is a block diagram schematically showing the whole arrangement of an electronic musical instrument according to an embodiment of the invention.
Figure 3:
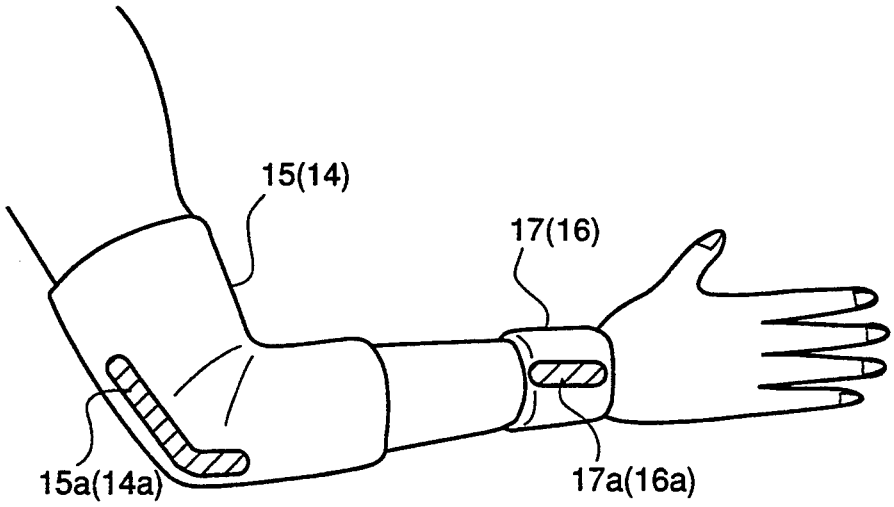
FIG. 3 is a fragmentary view showing an example of a right elbow controller and a right wrist controller both appearing in FIG. 2, which are fitted on the right arm of an operator.

An electronic musical instrument according to an embodiment of the invention has left and right elbow controllers for detecting angles formed by elbows of respective left and right arms, and left and right wrist controllers for detecting angles formed by respective left and right wrists. The right elbow controller 15 and right wrist controller 17 which are to be fitted on the right arm of an operator or player are shown in FIG. 3. The left elbow and wrist controllers 14, 16, which are to be fitted on the left arm of the operator are shown in FIG. 2 and have identical constructions with the right elbow and wrist controllers 15, 17. The electric musical instrument also has grip controllers 18, 19 shown in FIG. 4. The grip controllers 18, 19 are to be held or gripped by respective left and right hands and operated with fingers and thumbs by turning on or off key switches arranged thereon. The operator performs delicate and fine control of the pitch of musical tones by the angles of his elbow(s) and wrist(s), which are detected by the elbow controllers 14, 15 and wrist controllers 16, 17. The operator also controls generation/stoppage of musical tones and adjusts the octave of musical tones by turning on or off the key switches on the grip controllers 18, 19.

FIG. 2 schematically shows the whole arrangement of the electronic musical instrument according to the present embodiment.

In the Figure, reference numeral 10 designates a control processing unit (CPU) which controls the operation of the instrument. Connected via a bus 11 to the CPU 10 are a ROM 12, a RAM 13, detection circuits 21 to 27, a pitch register 30, and a tone parameter register 31. The ROM 12 stores operation control programs, and the RAM 13 is adapted to store data related to operative states of the controllers 14 to 19. Connected, respectively, to the detection circuits 21 to 27 are the left and right elbow controllers 14, 15, the left and right wrist controllers 16, 17, the left and right grip controllers 18, 19, and a table-setting operating element 20. The elbow controllers 14, 15 and the wrist controllers 16, 17 have strain sensors which detect the angles of the operator's elbows and wrists, and deliver analog outputs indicative of the sensed angles to the respective detection circuits 21 to 26. The detection circuits 21 to 24 convert analog outputs from the elbow controllers 14, 15 and the wrist controllers 16, 17 into digital data. The detection circuits 25, 26 detect which of the key switches of the respective grip controllers 25, 26 is/are turned on. The detection circuit 27 detects the operative states of the table-setting operating element 20. The table-setting operating element 20 may be formed by key switches such as ten-keys, not shown.

The pitch register 30 is adapted to store data on the pitch of musical tones determined through operation of the controllers 14 to 19, and the tone parameter register 31 store parameters for determining the tone color of musical tones, etc. These registers 30, 31 are connected to a tone generator 32, which forms a musical tone signal based on data on the pitch, tone color, etc. of musical tones. The musical tone signal is amplified and converted into musical tones by a sound system 33.

As already described before, the right elbow controller 15 and the right wrist controller 17 are fitted on the right arm, as shown in FIG. 3. As shown in the Figure, when the present electronic musical instrument is in use, the elbow controller 15 and the wrist controller 17 are both fitted on the elbow and wrist of the operator, respectively, in the same manner as so-called elbow and wrist supporters are fitted thereon. The strain sensors 15*a*, 17*a* are provided on outer side portions of the elbow and wrist controllers 15, 17, respectively. The strain sensors 15*a*, 17*a* detect the bending angles of the right elbow and the right wrist, by generating outputs indicative of their own electric resistance values, which continuously vary as forces are applied thereto when the arm and the wrist are bent or stretched.

Figure 4:
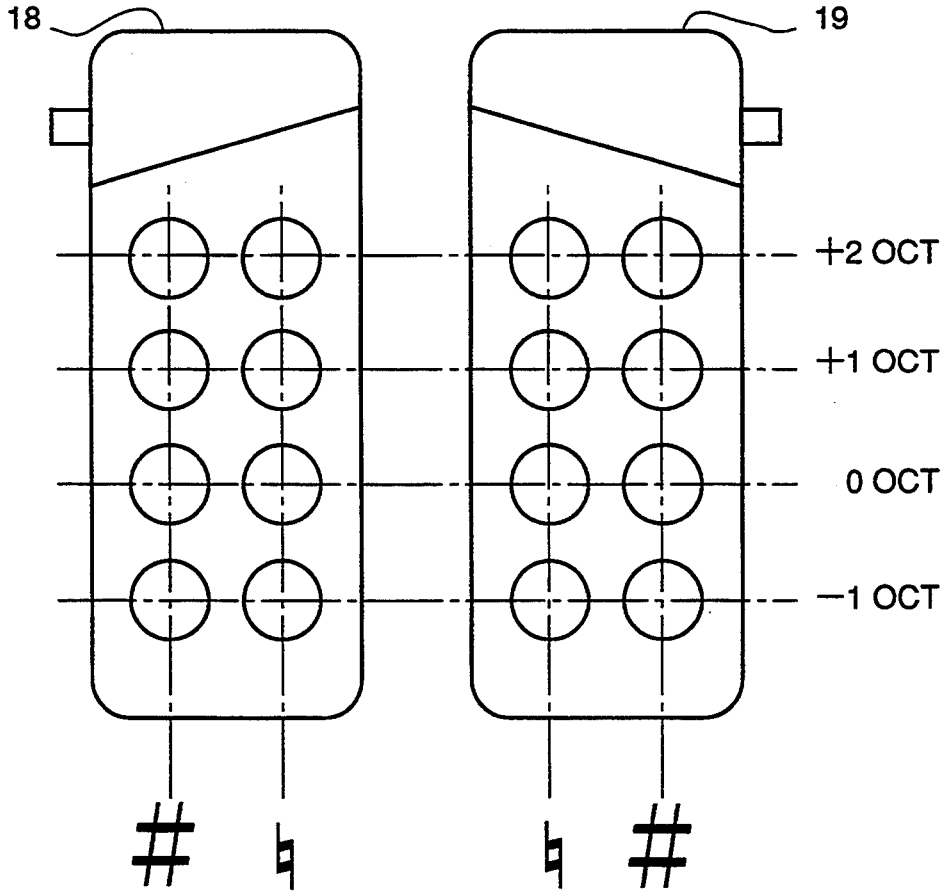
FIG. 4 is a front view showing left and right grip controllers appearing in FIG. 2.

FIG. 4 shows front faces of the grip controllers 18, 19. The operator grips each of them by hand with the back side thereof abutting against the palm and the second finger (forefinger) to the fifth finger (little finger) positioned opposite the front side face through the natural switch side. The left and right grip controllers have quite the same function, and two key switches are assigned to each of the second to fifth fingers. The key switches are selectively pushed or turned on to designate the octave of a musical tone, and sharp a tone, as well as to instruct generation/stoppage of musical tones. The key switches comprise a row of natural switches located on a side close to the fingers, and a row of sharp switches located on a side remote from the fingers.

The key switches corresponding to the second finger are adapted to cause generation of musical tones in a +2 octave range (with C5 as the lowest note). When the natural switch corresponding to the second finger is turned on, musical tones (scale tones) within an octave from C5 to C6, designated by the elbow controller 14, 15 and the wrist controller 16, 17, are generated in C major, whereas when the sharp switch corresponding to the second finger is turned on, a musical tone higher than each C major tone by a half tone (semitone) is generated. When a natural switch or a sharp switch corresponding to the third finger is turned on, musical tones in a +1 octave range (with C4 as the lowest note) are generated. When a natural switch or a sharp switch corresponding to the fourth finger is turned on, musical tones in a 0 octave range (with C3 as the lowest note) are generated. Further, when a natural switch or a sharp switch corresponding to the fifth finger is turned on, musical tones in a −1 octave range (with C2 as the lowest note) are generated.

FIG. 5A to FIG. 5D show examples of tables of (hereinafter referred to as "the controller tables") for converting angle data on the bending angles of the left and right elbows and the right wrist sensed by the left and right elbow controllers 14, 15 and the wrist controller 17 into output data for calculation of the pitch of musical tones. Each controller table is set such that output data are generated at 128 different levels from 0 to 127 in response to the angle data from the corresponding controller. The controller tables shown in FIG. 5A to FIG. 5D are stored in the ROM 12 and one of them is selected as desired by operating the aforementioned table-setting operating element 20 for each controller. In the present embodiment, to avoid troublesome operations for selecting individual tables from the respective controllers, several suitable combinations of tables are previously determined and stored in the ROM 12 as controller table sets (in the present embodiment, four controller table sets are provided, with each controller table set designated by a different number n=1, 2, 3, or 4 for discrimination from the other controller table sets). When one of the controller table sets is selected, a left elbow table, a right elbow table, and a right wrist table, which belong to the selected set, are automatically selected.

FIG. 5A shows one of the controller table sets which is designated by a number n =1 and consists of controller tables each being set such that the output value varies linearly and continuously relative to the angle value from the corresponding controller. FIG. 5B shows another one of the controller table sets which is designated by a number n=2 and consists of controller tables each being set such that the output value varies stepwise at intervals each approximately corresponding to a whole tone relative to the angle value from the corresponding controller. FIG. 5C shows a further one of the controller table sets designated by a number n=3 and consisting of controller tables each being set such that the output value varies stepwise at intervals each approximately corresponding to a semitone relative to the angle value from the corresponding controller. FIG. 5D shows a still further one of the controller table sets designated by a number n=4 and consisting of controller tables each being set such that the output value varies stepwise at intervals each approximately corresponding to three degrees relative to the angle value from the corresponding controller. In this connection, the stepwise input/output characteristics of the FIG. 5B and FIG. 5C tables are not such that the output values vary in a strict and stepwise manner, but the outputs vary with gentle gradients in the vicinity of desired values (whole tones and semitones) relative to the angle values, whereas at intermediate values between the desired values, the output values vary with steep gradients relative to the angle values. The output values from the tables are expressed in cents. However, the cent values are not directly applied as values indicative of pitches of musical tones, but they are converted again to values indicative of pitches by the use of one of pitch-conversion tables shown in FIG. 6A to FIG. 6C.

That is, a calculated value obtained by synthesizing the output data from the elbow tables and the wrist table is converted by one of the pitch-conversion tables of FIGS. 6A to 6C into a pitch (in cents) of a musical tone to be generated. In the present embodiment, as shown in FIG. 6A to FIG. 6C, three kinds of pitch-conversion tables are provided, and these tables are each designated by a different number m=1, 2, or 3. The pitch-conversion table of FIG. 6A (m=1) converts the calculated value into a pitch of a tone in a strictly stepwise manner. The pitch-conversion table of FIG. 6B (m=2) converts the calculated value into a pitch of a tone such that the output value (pitch) varies in a stepwise manner with inclinations, i.e. with alternate steep and gentle gradients. On the other hand, the pitch-conversion table of FIG. 6C converts the calculated value directly into a pitch (in cents) of a tone.

A variety of combinations of the tables shown in FIG. 5A to FIG. 6C are possible, which allow operators or players to select various manners of pitch determination according to their styles of playing.

FIG. 7 to FIG. 10 show programs for controlling the operation of the electronic musical instrument of the present embodiment.

Figure 7:
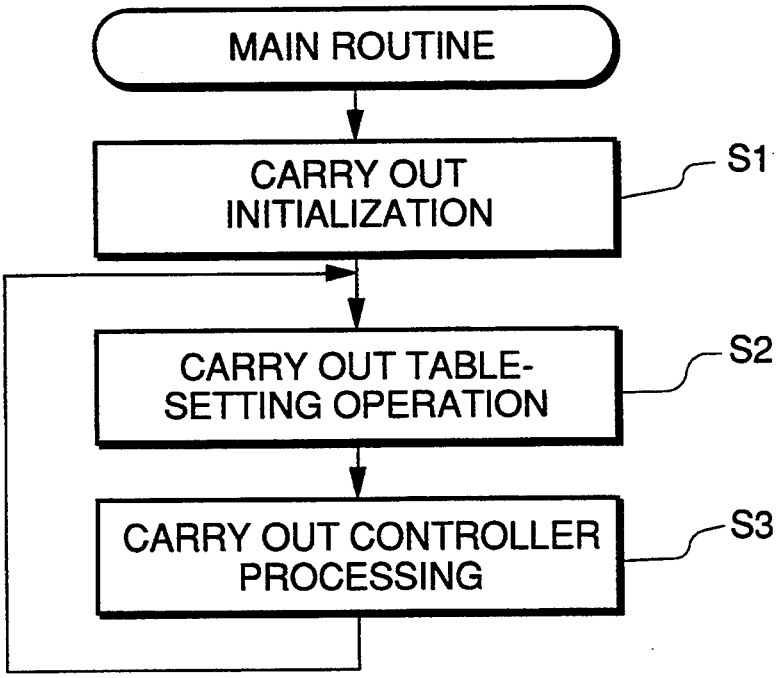
FIG. 7 is a flowchart of a main routine executed by a CPU appearing in FIG. 2.

FIG. 7 shows a main routine executed by the CPU 10 appearing in FIG. 2.

Upon closing of a power switch, not shown, of the musical instrument, initializations are carried out, such as interrupt initialization and table initialization, at a step S1. Then, a table-setting subroutine and a controller processing subroutine are repeatedly carried out, at steps S2 and S3, respectively, as hereinafter described in detail.

Figure 8:
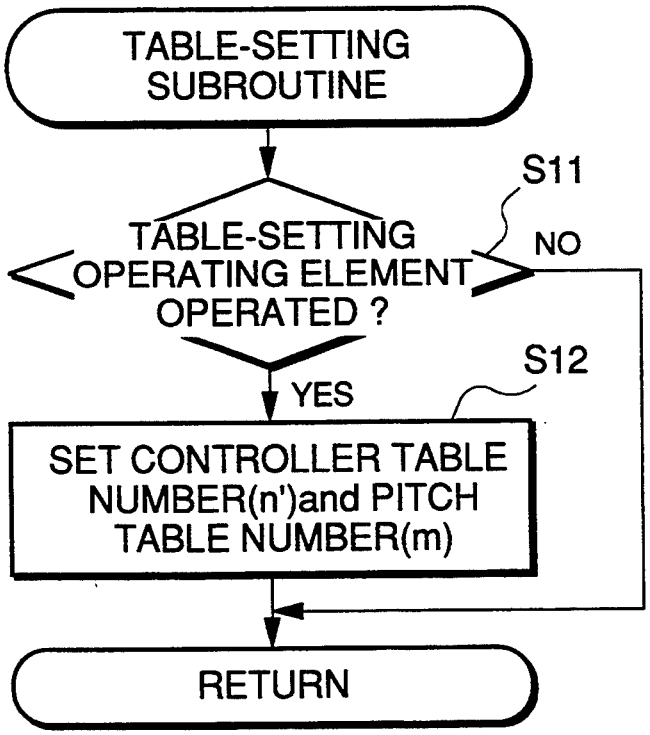
FIG. 8 is a flowchart of a table-setting subroutine executed at a step S2 in FIG. 7.

FIG. 8 shows details of the table-setting subroutine executed at the step S2 in FIG. 7. First, it is determined whether or not the table-setting operating element 20 has been operated. If it has not been operated, the present subroutine is terminated. If the operating element 20 has been operated, a number n indicative of a combination of the tables selected by the operating element 20 is stored into the RAM 13 in FIG. 2 at an area n thereof. If one of the pitch-conversion tables is newly selected, a number m indicative of the selected one is stored into the RAM 13 (step S12) at an area m thereof.

Figure 9:
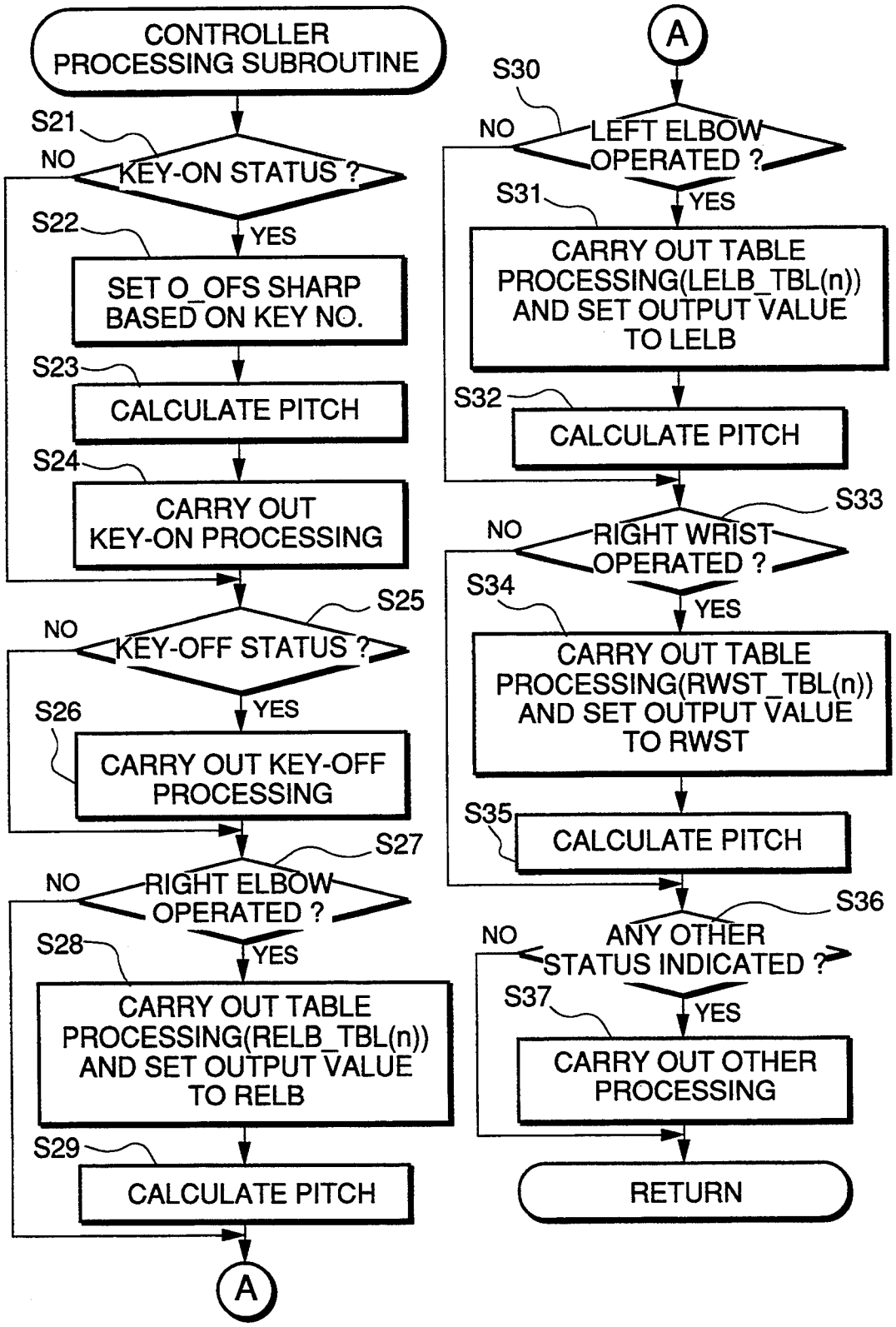
FIG. 9 is a flowchart of a controller processing subroutine executed at a step S3 in FIG. 7.

FIG. 9 shows details of the controller processing subroutine executed at the step S3 in FIG. 7. This subroutine is to determine pitch data based on angle data from the elbow, wrist and grip controllers 14 to 19.

First, it is determined at a step S21 whether or not the status of controller data output indicates that a key switch of the grip controller has been turned on (i.e. key-on status). If the answer to this question is affirmative (YES), the program proceeds to a step S22, where an octave value corresponding to the number of the key switch turned on is stored into an O_OFS register, not shown, of the RAM 13 and data on whether the key switch turned on is a natural one or a sharp one into a SHARP register, not shown, of the RAM 13. The O_OFS register is adapted to store values of 0 to 4 indicative of respective octave values in this order. The SHARP register is adapted to store a value of 0 when the key switch turned on is a natural one, and a value of 1 when it is a sharp one. These data are used in executing a pitch-calculating routine at a step S23, described in detail hereinafter. Key-on processing is carried out at a step S24, following the pitch-calculating routine, to generate a musical tone having a pitch thus calculated, followed by the program proceeding to a step S25. On the other hand, if the answer to the question of the step S21 is negative (NO), the program jumps over to the step S25.

At the step S25, it is determined whether or not the status of controller data output indicates that the key switch of the grip controller has been turned off. If the answer to this question is affirmative, key-off processing is carried out at a step S26 to stop generation of a musical tone which has been being generated, followed by the program proceeding to a step S27. If the answer to the question of the step S25 is negative (NO), the program jumps over to the step S27.

At the step S27, it is determined whether or not the status of controller data output indicates that the right elbow controller 15 has been operated. If the answer to this question is affirmative (YES), angle data from the controller 15 is converted into an output value by the right elbow table RELB_TBL(n), and then a right elbow data register RELB, not shown, of the RAM 13 is updated by the output value at a step S28. Then, the pitch-calculating routine is executed at a step S29, followed by the program proceeding to a step S30. On the other hand, if the answer to the question of the step S27 is negative (NO), the program jumps over to the step S30.

At the step S30, it is determined whether or not the status of controller data output indicates that the left elbow controller 14 has been operated. If the answer to this question is affirmative (YES), angle data from the controller 14 is converted into an output value data by the left elbow table LELB_TBL(n), and then a left elbow data register LELB, not shown, of the RAM 13 is updated by the output value at a step S31. Then, the pitch-calculating routine is executed at a step S32, followed by the program proceeding to a step S33. On the other hand, if the answer to the question of the step S30 is negative (NO), the program jumps over to the step S33.

At the step S33, it is determined whether or not the status of controller data output indicates that the right wrist controller 17 has been operated. If the answer to this question is affirmative (YES), angle data from the controller 17 is converted into an output value by the right wrist table RWST_TBL(n), and then a right wrist data register RWST, not shown, of the RAM 13 is updated by the output value at a step S34. Then, the pitch-calculating routine is executed at a step S35, followed by the program proceeding to a step S36. On the other hand, if the answer to the question of the step S33 is negative (NO), the program jumps over to the step S36.

At the step S36, it is determined whether the status of controller data output indicates that any other status signal has been input. If the answer to this question is affirmative (YES), processing corresponding to this status is carried out at a step S37. On the other hand, if the answer to the question of the step S36 is negative (NO), the program is terminated.

Figure 10:
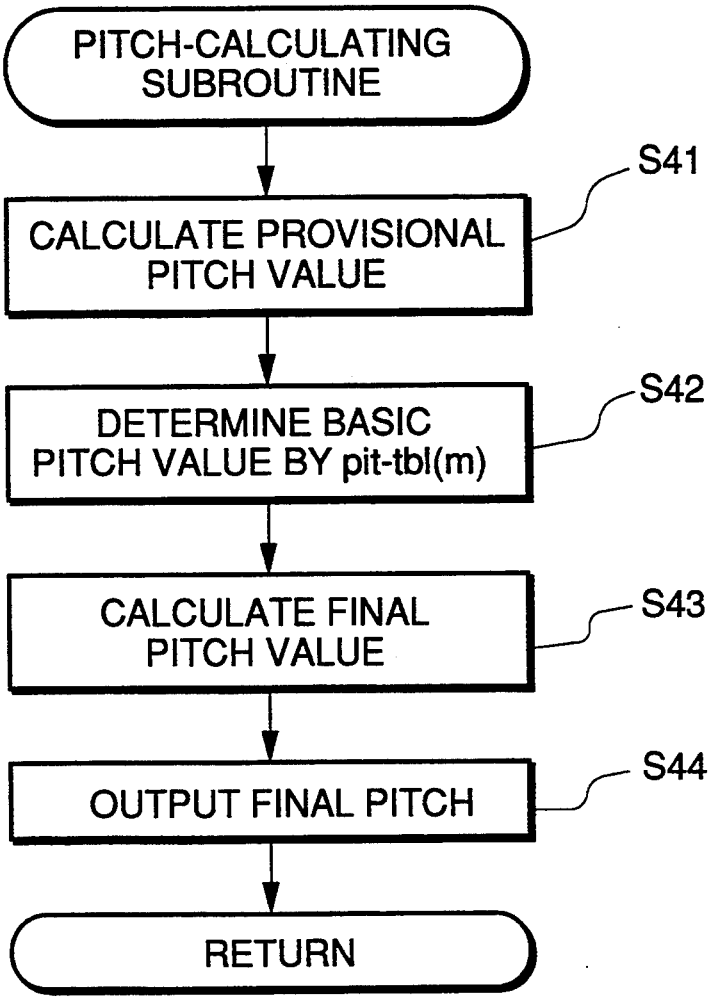
FIG. 10 is a flowchart of a pitch-calculating subroutine executed at a step S23, etc.

FIG. 10 shows details of the pitch-calculating subroutine executed at the steps S23, S29, S32, and S35 in FIG. 9. First, a scale calculation is performed at a step S41 by adding together output values obtained from the outputs from the controllers 14, 15. In the scale calculation, a provisional pitch value a is calculated by the use of the following equation:

$$a = LELB \times LELBCOFE/127 + RELB \times RELBCOEF/127$$

That is, the provisional pitch value a is determined by the output values from the left and right elbow controllers. In the equation, LELBCOEF and RELBCOEF represent either values of 400 and 700 or values of 500 and 800, respectively, and one of the two combinations is previously selected and stored. Then, the calculated provisional pitch value a is converted into a basic pitch value "pitch1" by the use of the pitch-conversion table pit_tb1(m) at a step S42. The basic pitch value "pitch1" is then processed based on output values obtained from angle data from the wrist controllers 16, 17 and key switch status data from the grip controllers 18, 19, to thereby determine a final pitch value "pit" at a step S43 by the use of the following equation:

$$pit = O_OFS \times 1200 + pitch1 + (RWST - 63)/63 \times 100 + sharp \times 100$$

Thus, the calculated final pitch value "pit" reflects octave shifting and sharping by the grip controllers 18, 19, and pitch bending by the right wrist controllers 16, 17. The final pitch value "pit" thus calculated is loaded into the pitch register 30 at a step S44.

As described above, according to the invention, combinations of a plurality of tables can be selected to convert angle data obtained by motions of elbows and wrists of the operator, which makes it possible to determine the pitch of musical tones in a various manner according to the operator or player's style of playing.

Further, if the tables of FIG. 5B (n=2) or FIG. 5C (n=3) are selected as the controller table set and at the same time the table of FIG. 6C (m=3) is selected as the pitch-conversion table, an output characteristic curve can be obtained, which has gentle gradients in the vicinity of scale tones (whole tones) or semitones, making it possible to easily determine desired pitches as well as to realize a delicate pitch variation, while at intermediate tone values between adjacent scale tones or semitones, the output characteristic curve has sharp gradients, making it possible to promptly shift the pitch. Further, similar pitch-determining characteristics can also be realized by selecting the table of FIG. 5A (n=1) as the controller table set and the table of FIG. 6B (n=2) as the pitch-conversion table.

Further, if two electronic musical instruments according to the invention are played in ensemble, with any of the tables of FIG. 5A to FIG. 5D selected as the controller table set and the table of FIG. 6B or FIG. 6C selected as the pitch-conversion table, it is possible to easily generate musical tones with an integer pitch ratio like a pure temperament. Further, this facilitates obtaining a chorus effect of delicately offsetting the pitches of two musical tones.

The invention is not limited to the above described embodiment, and variations and modifications thereto are possible within the scope of the appended claims. For example, the controller tables and the pitch-conversion tables are not limited to those in FIG. 5A to FIG. 5D and FIG. 6A to FIG. 6C. In addition to or alternatively of the three tables of FIG. 5A, there may be employed tables having input/output characteristics with different gradients, for example.

What is claimed is:

1. An electronic musical instrument comprising:

a plurality of detecting means, arranged respectively at predetermined joints of a human body or in the vicinity thereof, for detecting angles formed by respective ones of said predetermined joints, and for generating a plurality of angle data indicative of the respective detected angles;

a plurality of converting means, having different input/output characteristics, for converting angle data from the detecting means into respective frequency data each indicative of a frequency of a musical tone; and selecting means for selecting a desired converting means out of said plurality of converting means for use with a desired detecting means, whereby different input/output characteristics may be selected for the respective detecting means.

2. An electronic musical instrument according to claim 1, wherein said converting means comprise at least one first converting means each having a first linear input/output characteristic which has a first frequency characteristic curve linearly varying relative to said angles, and at least one second converting means each having a second input/output characteristic which has a second frequency characteristic curve varying at different rates relative to said angles between at least one predetermined range of said angles and other ranges of said angles adjacent to said at least one predetermined range.

3. An electronic musical instrument according to claim 2, wherein said at least one first converting means includes at least two converting means of which said first frequency characteristic curves vary at substantially constant rates but different from each other, relative to said angles.

4. An electronic musical instrument according to claim 2, wherein said at least one second converting means has said second frequency characteristic curve having a plurality of regions corresponding, respectively, to a plurality of ranges of said angles, said regions of said second frequency characteristic curve comprising at least one region varying at a first rate relative to said angles, and at least one region varying at a second rate relative to said angles, wherein the first rate is higher than the second rate.

5. An electronic musical instrument comprising:

a plurality of detecting means, arranged respectively at predetermined joints of a human body or in the vicinity thereof, for detecting angles formed by respective ones of said predetermined joints, and for generating a plurality of angle data indicative of the respective detected angles;

a plurality of first converting means, having different input/output characteristics, for converting angle data each indicative of a frequency of a musical tone;

a plurality of second converting means, having different input/output characteristics, for converting said frequency data obtained by said first converting means into respective output data indicative of said musical tone; and selecting means for selecting a desired first converting means out of said plurality of first converting means for use with a desired detecting means, and for selecting a desired second converting means out of said plurality of second converting means for use with a desired first converting means, whereby different angle-to-tone conversion characteristics may be selected for the respective detecting means.

6. An electronic musical instrument according to claim 5, wherein said second converting means comprise at least one converting means each having a linear input/output characteristic which has a frequency characteristic curve linearly varying relative to said frequency of said musical tone, and at least one converting means each having an input/output characteristic which has a frequency characteristic curve varying at different rates relative to said frequency of said musical tone between at least one predetermined range of said angles and adjacent other ranges of said angles adjacent to said at least one predetermined range.

7. An electronic musical instrument comprising:

a plurality of detecting means, arranged respectively at predetermined joints of a human body or in the vicinity thereof, for detecting angles formed by respective ones of said predetermined joints, and for generating a plurality of angle data indicative of the respective detected angles;

a plurality of converting means, having different input/output characteristics, for converting angle data from the detecting means into respective frequency data each indicative of a frequency of a musical tone; and selecting means for selecting a desired converting means out of said plurality of converting means for use with a desired detecting means, whereby an operator may select different input/output characteristics for the respective detecting means according to a style of playing of said operator.

* * * * *